US010881559B2

(12) United States Patent
Anderson

(10) Patent No.: US 10,881,559 B2
(45) Date of Patent: Jan. 5, 2021

(54) LIGHTWEIGHT COLLAPSIBLE CASUALTY LITTER

(71) Applicant: SFMed Concepts, Inc., Baton Rouge, LA (US)

(72) Inventor: Arthur P. Anderson, Baton Rouge, LA (US)

(73) Assignee: SFMED CONCEPTS INC., Baton Rouge, LA (US)

( * ) Notice: Subject to any disclaimer, the term of this patent is extended or adjusted under 35 U.S.C. 154(b) by 251 days.

(21) Appl. No.: 16/040,135

(22) Filed: Jul. 19, 2018

(65) Prior Publication Data

US 2020/0022851 A1 Jan. 23, 2020

(51) Int. Cl.

| | |
|---|---|
| ***A61G 1/00*** | (2006.01) |
| ***A61G 1/013*** | (2006.01) |
| ***A61G 1/044*** | (2006.01) |
| *A61G 1/048* | (2006.01) |

(52) U.S. Cl.

CPC ..... *A61G 1/013* (2013.01); *A61G 1/044* (2013.01); *A61G 1/048* (2013.01)

(58) Field of Classification Search

CPC ..... A61G 1/00
USPC ..... 5/625–628
See application file for complete search history.

(56) References Cited

U.S. PATENT DOCUMENTS

| | | | | |
|---|---|---|---|---|
| 3,176,321 A * | 4/1965 | Shump | A61G 1/013 | 5/627 |
| 3,597,773 A * | 8/1971 | Firestone | A61G 1/003 | 5/627 |
| 6,842,923 B1 * | 1/2005 | Castellani | A61G 1/013 | 16/228 |
| 2010/0176619 A1 * | 7/2010 | Cahaan | A61G 1/0231 | 296/20 |

* cited by examiner

*Primary Examiner* — Fredrick C Conley
(74) *Attorney, Agent, or Firm* — Workman Nydegger

(57) ABSTRACT

Collapsible, lightweight, and easy-to-assemble litters for transporting injured or incapacitated persons are disclosed. For example, a collapsible apparatus for transporting persons includes a frame assembly having a pair of frame rails. Each frame rail includes at least two telescoping rods connected by a hinge that can be configured to allow the frame rails to be folded upon each other. The collapsible apparatus can additionally include one or more collapsible tension rods secured to the pair of frame rails for selectively maintaining a lateral displacement of the pair of frame rails when the frame assembly is in an assembled configuration and a stretcher bed carried by the frame assembly that is configured to receive and support a person between the pair of frame rails when the frame assembly is in the assembled configuration.

12 Claims, 5 Drawing Sheets

LIGHTWEIGHT COLLAPSIBLE CASUALTY LITTER

BACKGROUND

Technical Field

This disclosure generally relates to portable litters, stretchers, and cots. More specifically, the present disclosure relates to lightweight, collapsible litters for transporting wounded, injured, or otherwise incapacitated persons or animals.

Related Technology

Litters and stretchers are devices used to carry injured or otherwise incapacitated persons from one place to another. Although the terms are often used interchangeably, a litter typically requires two or more people to carry, whereas a stretcher is generally equipped with a variable height frame and wheels to enable use by a single person. Stretchers are commonly used by medical personnel for transporting an injured or incapacitated person from one place to another and are particularly useful when evacuation is effectuated by ambulance or other motorized vehicle. These stretchers are impractical for use in rural, underdeveloped, disaster, and war affected terrains, however, because they are bulky and heavy, and their wheels are designed for use on relatively smooth surfaces such as concrete or tile.

Commonly carried by disaster response personnel, soldiers, and battlefield medics, portable litters are better suited for use on rugged terrain where stretchers are impractical. Portability is generally achieved by a collapsible design, enabling the litter to be carried on the person. Despite being collapsible, many portable litters are heavy and bulky and therefore difficult to stow and carry. This difficulty is exacerbated by the amount of additional gear that response personnel and medics or soldiers are required to carry. Currently available litters are also difficult to assemble in a hurry, which is of significant importance when effectuating the evacuation of a wounded or injured person from a dangerous situation to a suitable location for further medical treatment.

Accordingly, there are a number of disadvantages with portable litters that can be addressed.

BRIEF SUMMARY

Implementations of the present disclosure solve one or more of the foregoing or other problems in the art with portable litters. In particular, one or more implementations can include a collapsible apparatus for transporting persons that includes a frame assembly having a pair of frame rails. Each frame rail includes at least two telescoping rods connected by a hinge that can be configured to allow the frame rails to be folded upon each other. The collapsible apparatus can additionally include one or more collapsible tension rods secured to the pair of frame rails for selectively maintaining a lateral displacement of the pair of frame rails when the frame assembly is in an assembled configuration, and a stretcher bed carried by the frame assembly that is configured to receive and support a person between the pair of frame rails when the frame assembly is in the assembled configuration.

Embodiments of the present disclosure can also include a collapsible apparatus for transporting persons having a frame assembly that includes (i) a pair of frame rails, (ii) one or more tension rods secured to the pair of frame rails, and (iii) a stretcher bed carried by the pair of frame rails. Each frame rail can include two telescoping rods configured longitudinally and connected by a hinge configured to allow the two frame rails to be folded upon each other. The tension rods are secured to the pair of frame rails to selectively maintain a lateral displacement of the pair of frame rails when the frame assembly is in an assembled configuration. Each of the one or more tension rods includes a first crossbar having an externally threaded end and a turn handle secured to the first crossbar through a plurality of internal threads complementary to the externally threaded end of the first crossbar. The turn handle can additionally include a collared end with an inside diameter sidewall forming one or more arcuate depressions. Each tension rod can additionally include a second crossbar that has a flanged end sized and shaped to associate with the collared end of the turn handle and a ball plunger secured to the flanged end. The ball plunger has a spring-loaded ball configured to associate with the hemispherical depressions within the collared end of the turn handle to secure the turn handle in a longitudinal position. A tether is secured to the externally threaded end of the first crossbar and to the flanged end of the second crossbar. The stretcher bed is configured to receive and support a person between the pair of frame rails when the frame assembly is in the assembled configuration.

Accordingly, apparatuses for transporting persons are disclosed.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Figure 1:
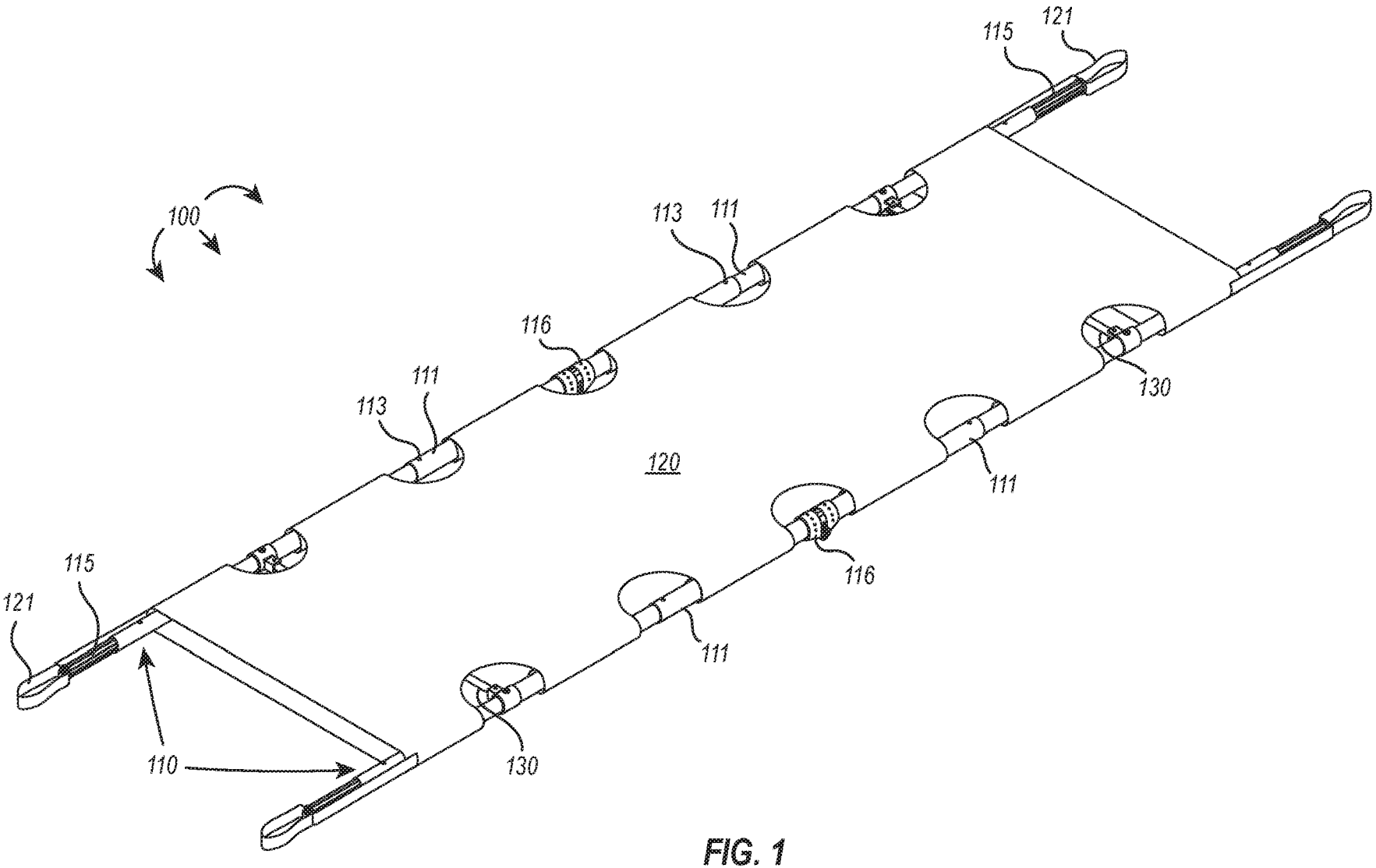
FIG. 1 illustrates a perspective view of an exemplary collapsible litter for transporting persons in an assembled configuration.

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments, and is not necessarily intended to limit the scope of the claimed invention.

As provided above, there are a number of disadvantages associated with systems, apparatuses, and methods for carrying injured or otherwise incapacitated persons from one place to another. For example, stretchers that are commonly used by medical personnel for transporting an injured or incapacitated person are impractical for use in rural, underdeveloped, disaster, and war affected terrains because they are bulky and heavy, and they generally employ wheels that are designed for use on relatively smooth surfaces such as concrete or tile. Portable casualty litters are generally more suited for use on terrains where such stretchers are impractical, but they present their own disadvantages. For example, many portable casualty litters are difficult to stow and carry because they are heavy and bulky. Additionally, these litters can be difficult to assemble under the pressures of a disaster response or combat scenario.

Embodiments of the present disclosure include lightweight casualty litters that are collapsible, compact, and easy to assemble. In some embodiments, the litter includes two frame rails, displaced laterally from one another, each frame rail including a system of hinges and telescoping rods that enable them to be collapsed to a reduced size. Each frame rail can be constructed by joining two telescoping rods with a hinge, enabling each frame rail to be significantly reduced in size by retracting the telescoping rods and folding the rail in half via the hinge. Additionally, some embodiments include telescoping rods with spring button locks that stop in specified positions, ensuring that extension of the telescoping rods is easy to accomplish quickly in high-stress situations such as a disaster response or combat scenario where time is of the essence.

Other embodiments may include different locking mechanisms, such as twist or snap style locks, to accomplish similar results or other design goals, such as length adjustability. In each case, the disclosed litters enable field personnel to more quickly evacuate injured persons, which increases the safety of the injured person and the responding person(s) by decreasing the amount of time they are in a combat scenario or other dangerous situation. The quick assembly litters disclosed herein can additionally decrease the amount of time it takes for the injured person to receive medical treatment because less time is being spent assembling the litter.

In some embodiments, a stretcher bed is secured to the two frame rails and adapted for receiving and supporting a person between the frame rails. The stretcher bed is constructed of a material capable of being compressed and/or folded upon itself as the frame rails are collapsed. Alternatively, a removable stretcher bed may be implemented.

In some embodiments, one or more tension rods are secured to the frame rails for maintaining their lateral displacement and applying tension to the stretcher bed so that it may more effectively support a person. Each of the one or more tension rods include two crossbar elements, each of which are secured to opposing frame rails on one end and detachably secured to each other at some point between the two frame rails. In some embodiments, a tether is attached to the detachable ends of corresponding crossbar elements for maintaining them in proximity when the tension bar is in a collapsed configuration. Additionally, in some embodiments, each of the one or more tension rods includes a mechanism for adjustably applying tension to the tension rod. The adjustable tension bar enables adjustment of the tightness of the stretcher bed, and ensures that the casualty litter remains rigid during operational use. The detachability of the crossbars that make up each tension rod enables the casualty litter to be reduced to a compact size for stowage, and the adjustable tension bar ensures ease of assembly for operational use. Additionally, in some embodiments, the adjustable tension rod includes means for locking the tension rod in a desired configuration, ensuring that the applied tension is maintained during operational use. This can be particularly beneficial in situations where the casualty litter is used in rugged terrain so that an inadvertent bump or collision with environmental objects does not cause the tension rod to collapse or fold.

Embodiments of the present disclosure provide additional benefits over prior art litters. For example, at least some of the collapsible casualty litters disclosed herein include features that decrease the weight of the litter without sacrificing structural integrity or ease of use. Such features can include hollow frame rails constructed of a lightweight alloy or carbon fiber, hinges made of a durable, lightweight metal alloy that have a plurality of apertures for reducing the weight of the hinge, and handles made of a lightweight polymer. The reduced weight of the disclosed collapsible litters makes it possible for personnel to carry the improved litter into more situations without overburdening them or by increasing their load to a point where other equipment would be substituted in place of the litter. Accordingly, field personnel can be more prepared to respond to and evacuate injured persons and can do so more quickly and easily as compared with prior art litters. These benefits can save lives and decrease morbidity in the field, among other things.

Referring now to FIG. 1, illustrated is a perspective view of a collapsible casualty litter 100 in an assembled configuration for operational use. As depicted, a stretcher bed 120 is held in a configuration for receiving and carrying a person between a pair of frame rails 110. In this embodiment, each frame rail 110 includes a pair of telescoping rods 111 connected by a hinge 116, enabling the casualty litter 100 to be collapsed into a compact size for stowing between uses. When carrying a person, the casualty litter 100 is preferably lifted by the included lift handles 115. A loop handle 121 can be attached to each of the lift handles 115 and to the stretcher bed 120 to provide a convenient means for extending the telescoping rods 111 upon assembly of the casualty litter 100.

Figure 2:
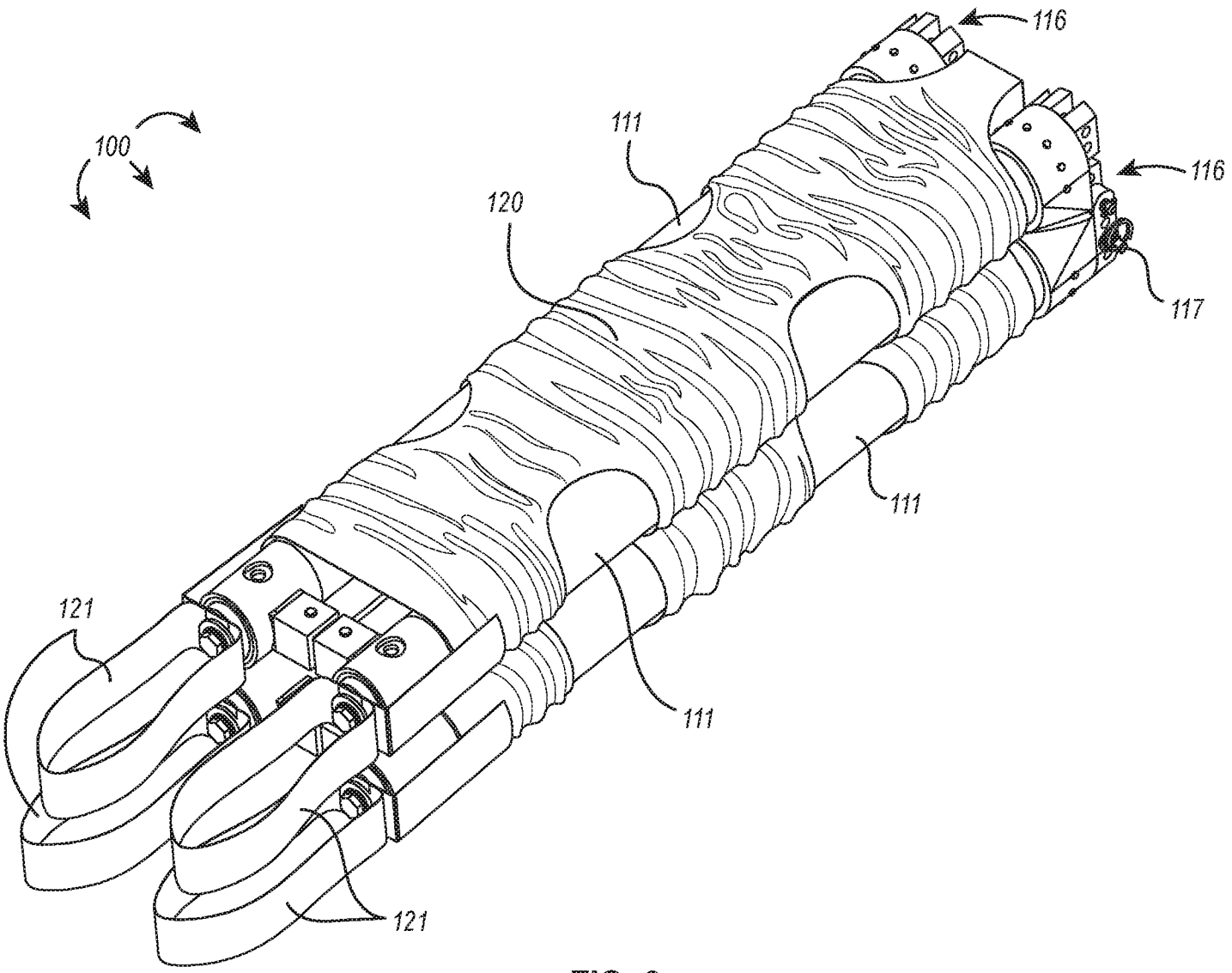
FIG. 2 illustrates a perspective view of the collapsible litter of FIG. 1 in a collapsed configuration.

The casualty litter 100 can be collapsed into a compact configuration (as shown in FIG. 2) by retracting the telescoping rods 111 and folding the frame rails at their corresponding hinges 116. The spring buttons 113 ensure that the litter remains in a rigid configuration when in use, but the telescoping rods 111 may be retracted by pushing the spring buttons 113 while applying force along the length of the telescoping rod 111. When assembled, the lateral displacement of the frame rails 110 is maintained by one or more tension rods 130.

FIG. 2 illustrates a perspective view of the casualty litter 100 in a collapsed configuration for stowing between uses. As depicted, the stretcher bed 120 is compressed and folded when the telescoping rods 111 are retracted and the casualty litter 100 is folded at the hinges 116. Also visible in FIG. 2 is a cotter pin 117 associated with at least one of the hinges 116 to enable the casualty litter 100 to be locked in a rigid configuration when assembled for operational use (as shown in FIG. 1) or to prevent the hinge 116 from opening when stored. As previously stated, the loop handles 121 provide a convenient means for extending the telescoping rods 11 while simultaneously tightening the stretcher bed 120 for operational use but can additionally be used to secure the litter 100 to a pack or supply carriage.

Figure 3:
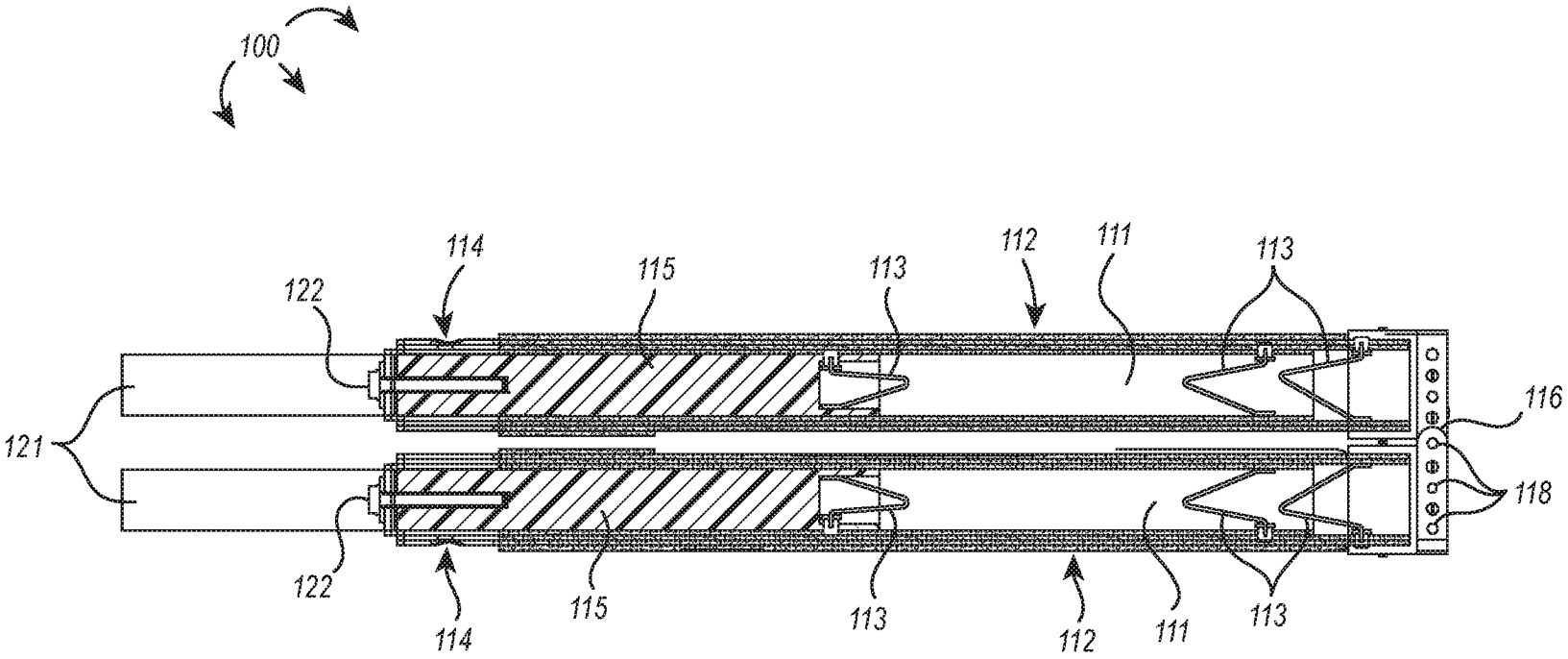
FIG. 3 illustrates a cross-sectional view of a collapsed litter taken along the longitudinal axis of the frame rail.

FIG. 3 illustrates a cross-sectional view of an exemplary collapsed litter 100 taken along the longitudinal axis of the frame rail 110. As depicted, multiple concentric tubes 112 are configured to telescope to a specified position when the spring buttons 113 reach corresponding button holes 114. Alternatively, the quantity and length of concentric tubes or the number and placement of button holes may be varied to achieve different weights and sizes.

The cross sectional profile of the telescoping rods may vary across embodiments to achieve lighter weights, greater load capacities, higher resistance to torsional forces, and improved manufacturability. For example, some embodiments of the invention comprise telescoping rods with an oblong cross section configured to provide greater strength against vertical forces (i.e. when the stretcher bed is loaded with a person). An oblong shape also provides torsional resistance to the telescoping rods, which enables a faster assembly of the casualty litter by ensuring that the button holes are maintained in alignment with the corresponding spring buttons. A preferred embodiment comprises telescoping rods having an ovate cross section. It should be appreciated that the telescoping rods may comprise any cross sectional profile that permits the concentric tubes to be collapsed within each other longitudinally. For example, alternative embodiments of the telescoping rods may comprise concentric tubes with round, oblong arcuate, or polygonal cross sections.

Also depicted are lift handles 115, constructed of a solid, preferably lightweight material, and secured within the concentric tubes 112 of the telescoping rods 111 by a spring button 113, such that they may be collapsed within the telescoping rods 111 to which they are attached. In some embodiments, the lift handles are made of or include a durable lightweight polymer that can endure temperature extremes and heavy use commonly experienced by field personnel, thereby reducing the weight of the litter while maintaining durability and utility.

As shown in FIG. 3, the loop handles 121 are secured to the lift handles 115 by bolts 122, enabling them to be pulled as a means for extending the telescoping rods 111. It should be appreciated that the illustrated bolts 122 are exemplary in nature and that other attachment mechanisms are envisioned within the scope of the disclosure. For example, the loop handles can be molded into the lift handles, secured by an adhesive, riveted to the lift handles, or form a unitary piece with the lift handles. The placement of the loop handles beneficially enable the litter to be manipulated easily and can decrease the amount of time necessary to assemble the litter.

As shown in FIG. 3, the hinges 116 define a plurality of apertures 118. The apertures 118 can serve to reduce the overall weight of the litter 100 but can additionally be used in cooperation with a cotter pin or other mechanism to lock the hinges in a closed configuration. In some embodiments, the hinges 116 can be made of a lightweight metal alloy or lightweight polymer to additionally decrease the weight of the litter 100. The number and size of the apertures can vary and can depend on the type of material used to create the hinge. In some embodiments, the apertures remove up to 50% of the total weight of the hinge and can maintain structural integrity under a force of about 300 lbs.

Figure 4A:
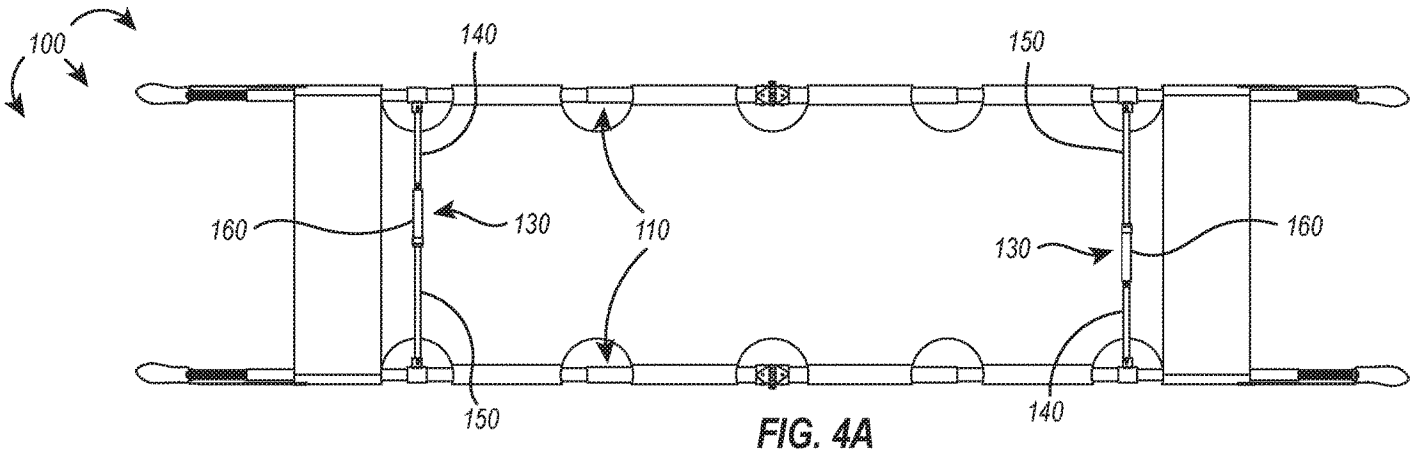
FIG. 4A illustrates a bottom view of the collapsible litter of FIG. 1.
Figure 4B:
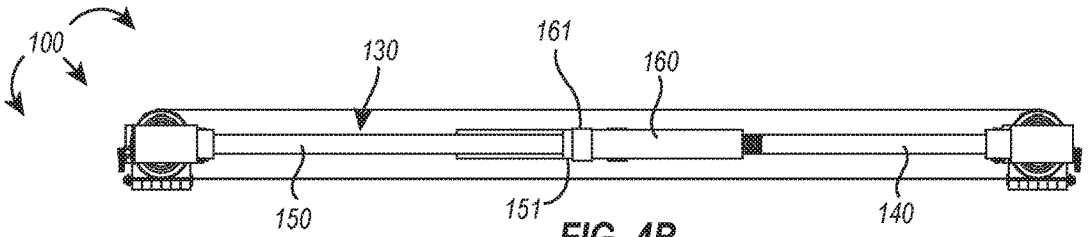
FIG. 4B illustrates a side view of the collapsible litter of FIG. 1.
Figure 4C:
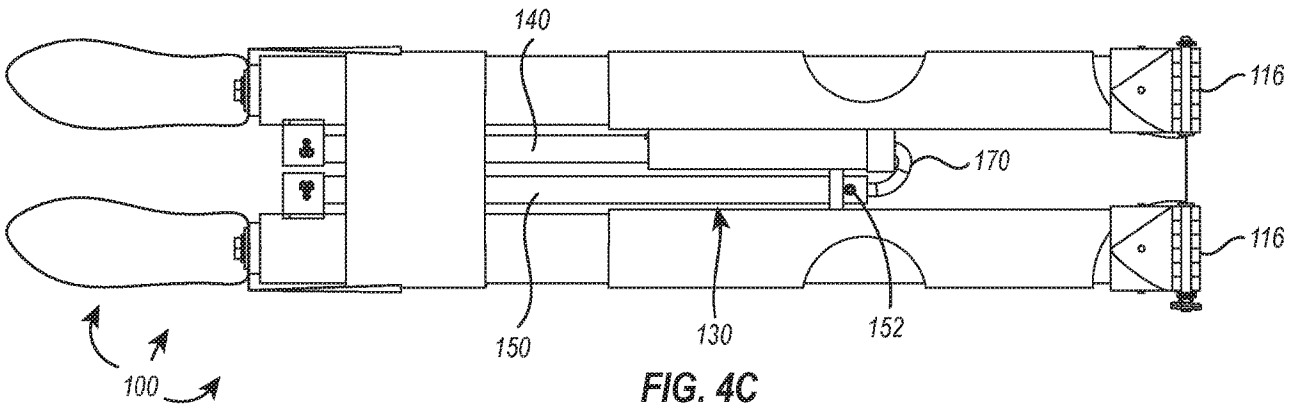
FIG. 4C illustrates a cross-sectional view of the collapsed litter of FIG. 2 taken along the center of the hinges.

FIGS. 4A through 4C illustrate an exemplary tension rod 130. As illustrated in FIG. 4A, the tension rod 130 is secured to a pair of frame rails 110 for maintaining them in a lateral displacement wherein the frame rails 110 are positioned substantially in parallel. As depicted, the tension rods 130 include a turn handle 160, which can be used to support the litter in an open configuration and to adjust a slackness or tautness of the bed. The tension rod 130 can be attached to the frame rails by a hinge or can be positioned on a swivel so that the tension rod 130 can be positioned transverse, preferably orthogonal, to the frame rails 110 in an open configuration (as shown in FIG. 4A) and collapsed along the frame rail 110 in a closed configuration (as shown in FIGS. 4B and 4C).

As shown in FIGS. 4A and 4B, the turn handle 160 is secured to the externally threaded crossbar 140 and can be configured to move longitudinally along the externally threaded crossbar 140 by twisting the turn handle 160. As shown in FIG. 4B, which illustrates a side view down the exemplary casualty litter 100, the turn handle 160 includes a collar 161 that associates with a flange 151 on the flanged crossbar 150. Tension is applied to the tension rod 130 by tightening the collar 161 against the flange 151. As described above, this movement can be accomplished by twisting the turn handle 160 about the externally threaded crossbar 140. Similarly, the tension rod 130 can be collapsed by twisting the turn handle 160 such that it moves away from the flange 151 until it is no longer associated with the flanged crossbar 150.

A view of the tension rod 130 in a collapsed configuration is provided in FIG. 4C, which illustrates a cross-sectional view taken along the center of the hinges 116 of the exemplary casualty litter 100 in its collapsed configuration. As depicted, the externally threaded crossbar 140 and the flanged crossbar 150 are secured to each other by a tether 170. The tether 170 can ensure that the externally threaded crossbar 140 and the flanged crossbar 150 remain in close proximity when the tension bar 130 is collapsed and can enable a quick assembly by encouraging the pieces together in a proper orientation when expanded. In one embodiment, the tether enables automatic linearization of the tension rod in response to the frame rails being spaced apart. In another embodiment, the tether 170 is constructed of or includes an elastic (e.g., rubber) cord but could alternatively consist of any material that allows the tension rod to be collapsed while maintaining its components in close proximity.

FIG. 4C additionally depicts a bore 152 in the flanged crossbar 150. The bore 152 can receive a ball plunger 180 or other mechanism for locking the turn handle 160 in position and can additionally act to secure the tension rod 130 in a desired position when assembled for operational use.

Figure 5A:
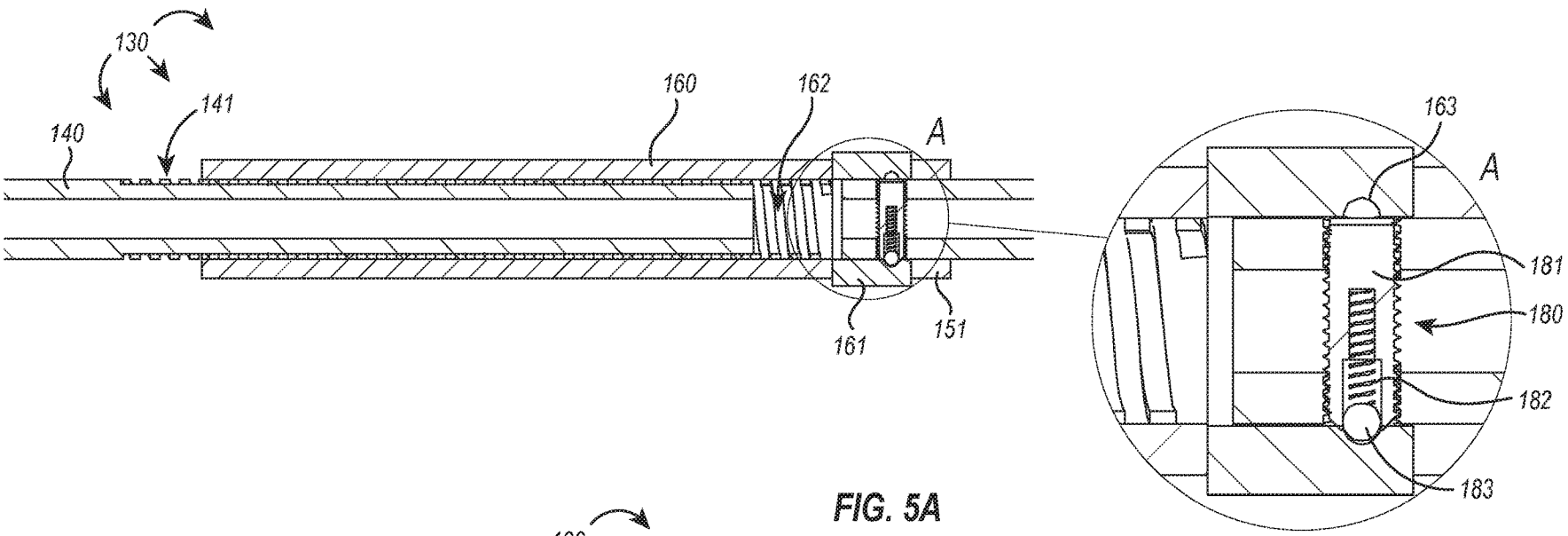
FIG. 5A illustrates a cross-sectional view of the tension rod of FIG. 4B taken along the longitudinal axis of the tension rod, including a zoomed-in view of the ball plunger.

FIG. 5A illustrates a cross-sectional view of an exemplary tension rod 130 taken along the longitudinal axis of the tension rod 130 and includes a detailed view of an exemplary ball plunger 180. As depicted, the turn handle 160 is secured to the externally threaded crossbar 140 through a plurality of internal threads 162 complementary to a plurality of external threads 141 on the externally threaded crossbar 140. As illustrated, the tension bar 130 is assembled for operational use by associating the collar 162 of the turn handle 160 with the flange 151 of the flanged crossbar 150 and twisting the turn handle 160 in such a direction that the collar 161 tightens against the flange 151. This embodiment thus enables the tension applied to the one or more tension bars 130 to be adjusted as desired.

In an alternative embodiment, the flange of the flanged crossbar is configured to be longitudinally adjustable. For example, adjustability of the flange is accomplished by use of an adjustable shaft collar. Adjustment of the flange's longitudinal position enables adjustment of the length of each tension rod in its assembled configuration by changing the point at which the turn handle pushes against the flange to form the tension rod. Additionally, in some embodiments, the stretcher bed is configured to have an adjustable width by use of a series of button fasteners, multiple strips of fabric hook and loop fastener, or other methods for detachably securing the stretcher bed to the frame assembly.

Figure 5B:
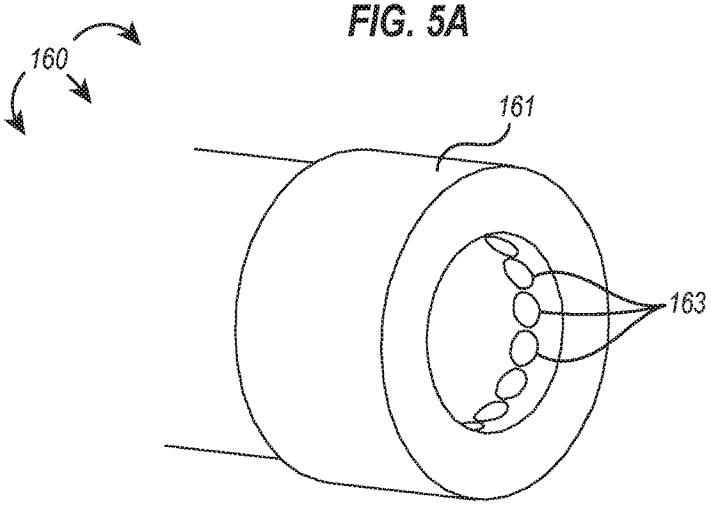
FIG. 5B illustrates a zoomed-in view of the turn handle of FIG. 5A, with an exemplary illustration of a plurality of depressions formed within an inner diameter of the turn handle for association with the ball plunger of FIG. 5A.

A zoomed in view of the ball plunger 180 is illustrated in detail A of FIG. 5A. As depicted, the ball plunger consists of a housing 181, a spring 182, and a ball 183 configured to induce friction on the inner surface of the collar 162 of the turn handle 160 by associating with any one of a plurality of depressions 163 in the interior surface of the collar 162 (as shown in FIG. 5B). The spring 182 pushes the ball 183 into any one of the depressions 163, inducing friction sufficient to lock the turn handle 160 in position during operational use of the casualty litter 100. In at least one embodiment, the depressions 163 are hemispherical in shape, but alternatively could consist of any number of shapes configured to receive the spring-loaded ball 183 to induce friction, such as an inverted pyramid, a cylindrical bore, or virtually any polygonal or arcuate shape.

A detailed view of an exemplary plurality of depressions 163 is provided in FIG. 5B, which illustrates a zoomed-in view of the exemplary turn handle 160. As depicted, the plurality of depressions 163 are arranged side by side within the inner diameter of the collar 161 of the turn handle 160. This embodiment enables the ball 183 of the ball plunger 180 to associate with one of the depressions 163 at small, incremental changes in tension corresponding to slight turns in the turn handle 160. Alternatively, varying numbers of depressions can be included inside the collar of the turn handle. For example, fewer depressions can be included and thereby include fewer locking positions of the tension rod. Alternative mechanisms for locking the turn handle in place are also considered. For example, an adjustable collar may be installed at either end of the turn handle to prevent any longitudinal movement during operational use of the casualty litter.

Individual components comprising the disclosed casualty litter can include one or more materials. For example, a casualty litter of the present disclosure can include one or more components made of or including metal alloys, durable plastics, or woven fabrics. For example, the telescoping rods may be preferably constructed of an aluminum alloy, but could additionally be made of stainless steel, titanium alloys, or carbon fiber. The lift handles of the disclosed casualty litter may be preferably constructed of a lightweight, durable plastic, but could additionally be made of carbon fiber or wood. The disclosed stretcher bed can preferably be constructed of a durable nylon fabric but could be made of any fabric material that is sufficiently strong for the desired application and sufficiently compressible to allow the disclosed casualty litter to be collapsed without the need to first remove the stretcher bed. Alternatively, a removable stretcher bed may be implemented and snapped (or otherwise affixed) to the expanded frame.

Unless defined otherwise, all technical and scientific terms used herein have the same meaning as commonly understood by one of ordinary skill in the art to which the present disclosure pertains.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated. Furthermore, binding, coupling, attaching, connecting, and/or joining can comprise mechanical and/or chemical association.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A collapsible apparatus for transporting persons, comprising:

a frame assembly, the frame assembly comprising:

a pair of frame rails, each frame rail comprising at least two telescoping rods connected by a hinge; and one or more collapsible tension rods secured to the pair of frame rails for selectively maintaining a lateral displacement of the pair of frame rails when the frame assembly is in an assembled configuration, wherein each of the one or more collapsible tension rods comprises:

a turn handle for adjusting the lateral displacement of the pair of frame rails;

a first crossbar having an externally threaded end, the turn handle being secured to the first crossbar through a plurality of internal threads complementary to the externally threaded end of the first crossbar and configured to move longitudinally along the first crossbar by twisting the turn handle; and a second crossbar having an adjustable flanged end configured to associate with the turn handle to secure the first and second crossbars longitudinally, wherein the turn handle is configured to tighten against the adjustable flanged end of the second crossbar when twisted and thereby apply a tension to the tension rod; and a stretcher bed carried by the frame assembly and configured to receive and support a person between the pair of frame rails when the frame assembly is in the assembled configuration.

2. The collapsible apparatus of claim 1, wherein each of the at least two telescoping rods is constructed of a lightweight material.

3. The collapsible apparatus of claim 2, wherein the lightweight material comprises a lightweight metal alloy or carbon fiber.

4. The collapsible apparatus of claim 2, wherein the hinge defines a plurality of apertures for reducing a weight of the hinge.

5. The collapsible apparatus of claim 1, wherein each of the at least two telescoping rods have an ovate cross sectional profile.

6. The collapsible apparatus of claim 5, wherein each of the at least two telescoping rods further comprises a loop handle secured to the solid lift handle.

7. The collapsible apparatus of claim 1, further comprising an elastic tether coupled to the externally threaded end of the first crossbar and to the adjustable flanged end of the second crossbar.

8. The collapsible apparatus of claim 1, wherein the second crossbar further comprises a ball plunger secured to the flanged end, the ball plunger comprising a spring-loaded ball configured to associate with one or more depressions formed into an inside diameter sidewall of a collared end of the turn handle.

9. The collapsible apparatus of claim 8, wherein the one or more depressions have an arcuate shape.

10. The collapsible apparatus of claim 8, wherein the one or more depressions have a polygonal shape.

11. The collapsible apparatus of claim 1, wherein each of the one or more tension rods further comprises a quick release shaft collar associated with the first crossbar.

12. A collapsible apparatus for transporting persons, comprising:

a frame assembly, the frame assembly comprising:

a pair of frame rails, each frame rail comprising two telescoping rods configured longitudinally and connected by a hinge, the hinge configured to allow the two frame rails to be folded upon each other;

one or more tension rods secured to the pair of frame rails for selectively maintaining a lateral displacement of the pair of frame rails when the frame assembly is in an assembled configuration, wherein each of the one or more tension rods comprises:

a first crossbar having an externally threaded end;

a turn handle secured to the first crossbar through a plurality of internal threads complementary to the externally threaded end of the first crossbar and comprising a collared end with an inside diameter sidewall forming one or more arcuate depressions;

a second crossbar comprising:

a flanged end sized and shaped to associate with the collared end of the turn handle; and a ball plunger secured to the flanged end, comprising a spring-loaded ball configured to associate with the hemispherical depressions within the collared end of the turn handle to secure the turn handle in a longitudinal position; and a tether secured to the externally threaded end of the first crossbar and to the flanged end of the second crossbar; and a stretcher bed carried by the pair of frame rails, the stretcher bed being configured to receive and support a person between the pair of frame rails when the frame assembly is in the assembled configuration.

* * * * *